US010786120B2

(12) United States Patent
Thews

(10) Patent No.: US 10,786,120 B2
(45) Date of Patent: Sep. 29, 2020

(54) MULTI-PANEL SHOWER DOOR ASSEMBLY

(71) Applicant: Starcraft Distribution Co., LLC, Bristol, IN (US)

(72) Inventor: Derek A. Thews, Elkhart, IN (US)

(73) Assignee: Starcraft Distribution Co., LLC, Bristol, IN (US)

( * ) Notice: Subject to any disclaimer, the term of this patent is extended or adjusted under 35 U.S.C. 154(b) by 99 days.

(21) Appl. No.: 16/207,697

(22) Filed: Dec. 3, 2018

(65) Prior Publication Data

US 2020/0170455 A1 Jun. 4, 2020

(51) Int. Cl.

| | |
|---|---|
| ***E05D 13/00*** | (2006.01) |
| ***A47K 3/34*** | (2006.01) |
| ***E05D 15/08*** | (2006.01) |
| ***E06B 1/70*** | (2006.01) |

(52) U.S. Cl.

CPC ..... *A47K 3/34* (2013.01); *E05D 15/08* (2013.01); *E06B 1/70* (2013.01); *E05Y 2900/114* (2013.01)

(58) Field of Classification Search

CPC .. A47K 3/34; E05D 15/08; E06B 1/70; E05Y 2900/114

USPC ..... 49/125, 410, 411; 4/557, 607, 612, 614

See application file for complete search history.

(56) References Cited

U.S. PATENT DOCUMENTS 3,384,998 A * 5/1968 Abramson ..... E05D 15/0626 49/411
3,896,508 A * 7/1975 Doan ..... A47K 3/34 4/557
4,014,070 A * 3/1977 Rifkin ..... A47K 3/34 16/90
4,228,560 A * 10/1980 Baus ..... A47K 3/34 16/90
4,258,443 A * 3/1981 Baus ..... A47K 3/34 16/90
4,458,449 A * 7/1984 Breuer ..... A47K 3/34 49/411
4,785,485 A * 11/1988 Etesam ..... A47K 3/34 4/557
5,469,666 A * 11/1995 Lewis, Jr. ..... E06B 1/70 49/467
5,675,936 A * 10/1997 Kurth ..... A47K 3/34 49/404
5,852,837 A * 12/1998 Husting ..... A47K 3/34 4/607
7,174,944 B1 2/2007 Clark et al.
7,346,939 B2 3/2008 Perry
9,856,684 B2 * 1/2018 Sidwell ..... E05D 15/0656
(Continued)

*Primary Examiner* — Jerry E Redman
(74) *Attorney, Agent, or Firm* — Dorton & Willis, LLP

(57) ABSTRACT

A multi-panel shower door assembly includes door panels supported near the top ends of the door panels for sliding movement relative to one another within a door frame. The door panels are supported such that bottom ends of the door panels are spaced above the bottom wall of a sill member to define an unobstructed free space between the bottom wall and the bottom ends of door panels. The sill member includes a sidewall extending upwardly from the bottom wall and an elongate, downwardly opening channel extending along an upper edge of the sidewall. A first rail member near the bottom end of the first door panel has an upwardly extending lip configured to be received in the channel to facilitate sliding movement of the door panels while inhibiting tilting movement of the door panels.

10 Claims, 7 Drawing Sheets

(56) References Cited

U.S. PATENT DOCUMENTS

| | | | | |
|---|---|---|---|---|
| 9,980,614 | B2 * | 5/2018 | Austin, III | A47K 3/34 |
| 10,161,171 | B2 * | 12/2018 | Lin | A47K 3/34 |

* cited by examiner

MULTI-PANEL SHOWER DOOR ASSEMBLY

TECHNICAL FIELD

The present invention relates generally to tub and shower enclosures, and more particularly to a multi-panel shower door assembly for use with shower and tub enclosures.

BACKGROUND

Slidable door panels are commonly used to enclose a space within a building or other structure. Multi-panel sliding doors are particularly well-suited for use in areas with limited space, such as tub or shower enclosures of motorhomes, campers, or other similar space-limited areas. Conventional multi-panel sliding door assemblies for shower enclosures include door panels that are suspended at their upper ends by roller assemblies for sliding movement along respective tracks disposed in a header assembly. Tracks are also generally provided on a sill member or sill plate at a lower end of the door panels to thereby guide the sliding movement of the door panels. In some conventional sliding door assemblies, the door panels may be alternatively or additionally supported at the lower ends of the door panels by rollers received in the tracks on the sill plate. These tracks also prevent lateral tilting of the bottom ends of the door panels.

One drawback of conventional multi-panel sliding doors used for shower enclosures is that the guide tracks at the sill plate tend to accumulate water. To address this problem, drain holes are often provided in the sill plate to facilitate water removal. However, such drain holes may become clogged with hair, soap film, etc., thereby creating undesirable conditions. Accordingly, there is a need for an improved shower enclosure having multi-panel sliding doors that overcome these and other drawbacks of conventional multi-panel door assemblies.

SUMMARY

The present invention provides a multi-panel door assembly suitable for use in areas with limited space, such as shower or tub enclosures. In one aspect, the door assembly is configured to facilitate easy installation of the door panels, and includes a sill member that is free from tracks, guides, or drain holes. While the invention will be described in connection with certain embodiments, it will be understood that the invention is not limited to these embodiments. On the contrary, the invention includes all alternatives, modifications and equivalents as may be included within the spirit and scope of the present invention.

In one aspect, an exemplary multi-panel shower door assembly in accordance with the principles of the present disclosure includes a first door panel and at least a second door panel supported proximate respective top ends of the door panels for sliding movement relative to one another within a door frame. The door panels are supported such that bottom ends of the door panels are spaced above the bottom wall of a sill member to define an unobstructed free space between the bottom wall and the bottom ends of door panels. The sill member includes a sidewall extending upwardly from the bottom wall and an elongate, downwardly opening channel extending along an upper edge of the sidewall. A first rail member proximate the bottom end of the first door panel has a lip extending upwardly from the bottom end of the first door panel. The lip is configured to be received in the channel, whereby cooperation between the lip and the channel facilitates sliding movement of the door panels while inhibiting movement of the first door panel in a direction perpendicular to the sliding movement.

In another aspect, the shower door assembly further includes a third door panel disposed between the first and second door panels. The third door panel is supported for sliding movement relative to at least one of the first or second door panels, and such that a, bottom end of the third door panel is spaced above the bottom wall of the sill member. In another aspect, first and second rail members are provided on the bottom ends of the first and second door panels. Each rail member includes a spacer leg extending laterally from the plane of the respective door panel in a direction toward the third door panel to engage the third door panel and maintaining a spacing between the door panels.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate exemplary embodiments of the invention and, together with a general description of the invention given above, and a detailed description given below, serve to explain the principals of the invention.

DETAILED DESCRIPTION

Figure 1:
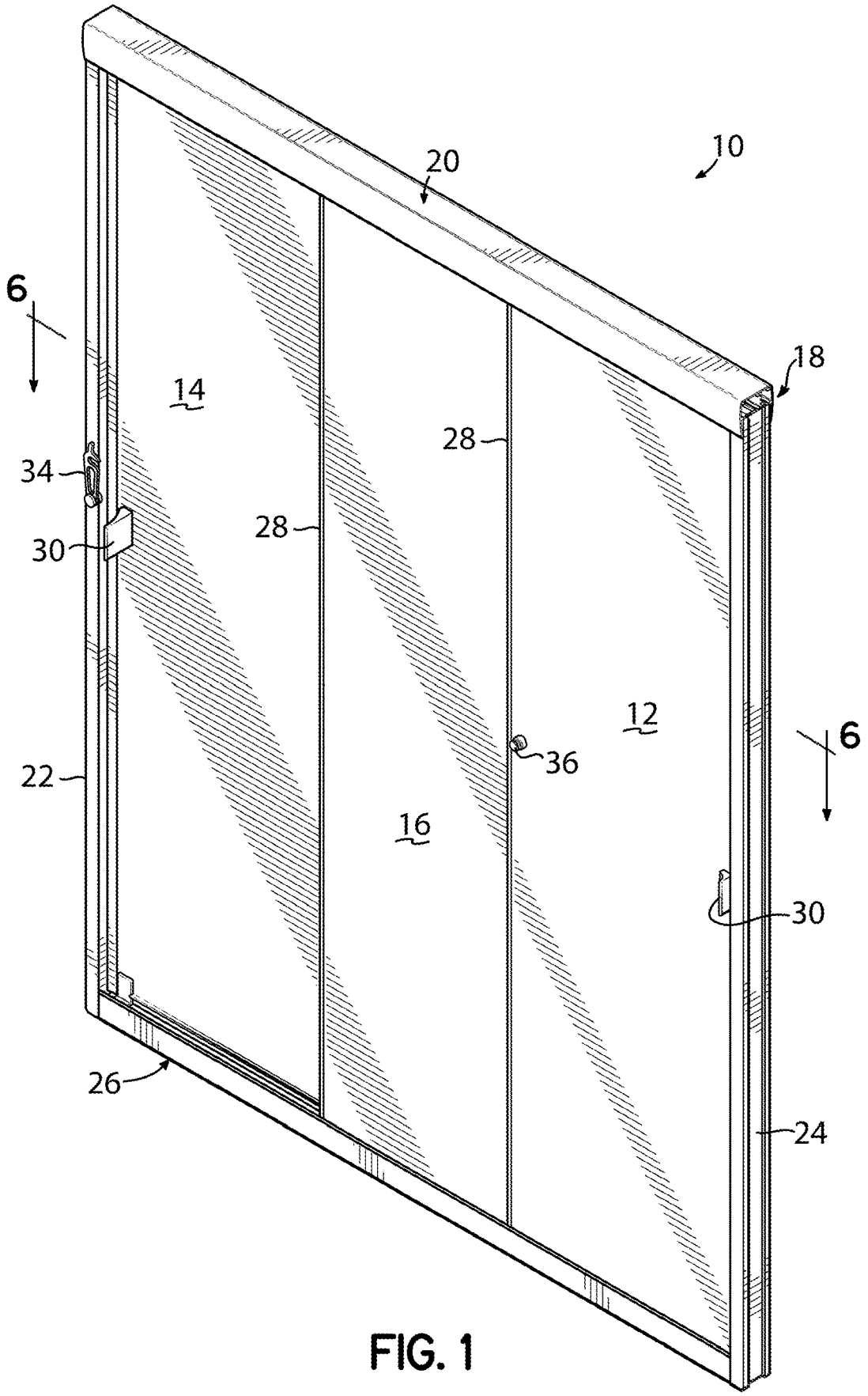
FIG. 1 is a perspective view of an exemplary shower door assembly in accordance with the principals of the present disclosure.
Figure 2:
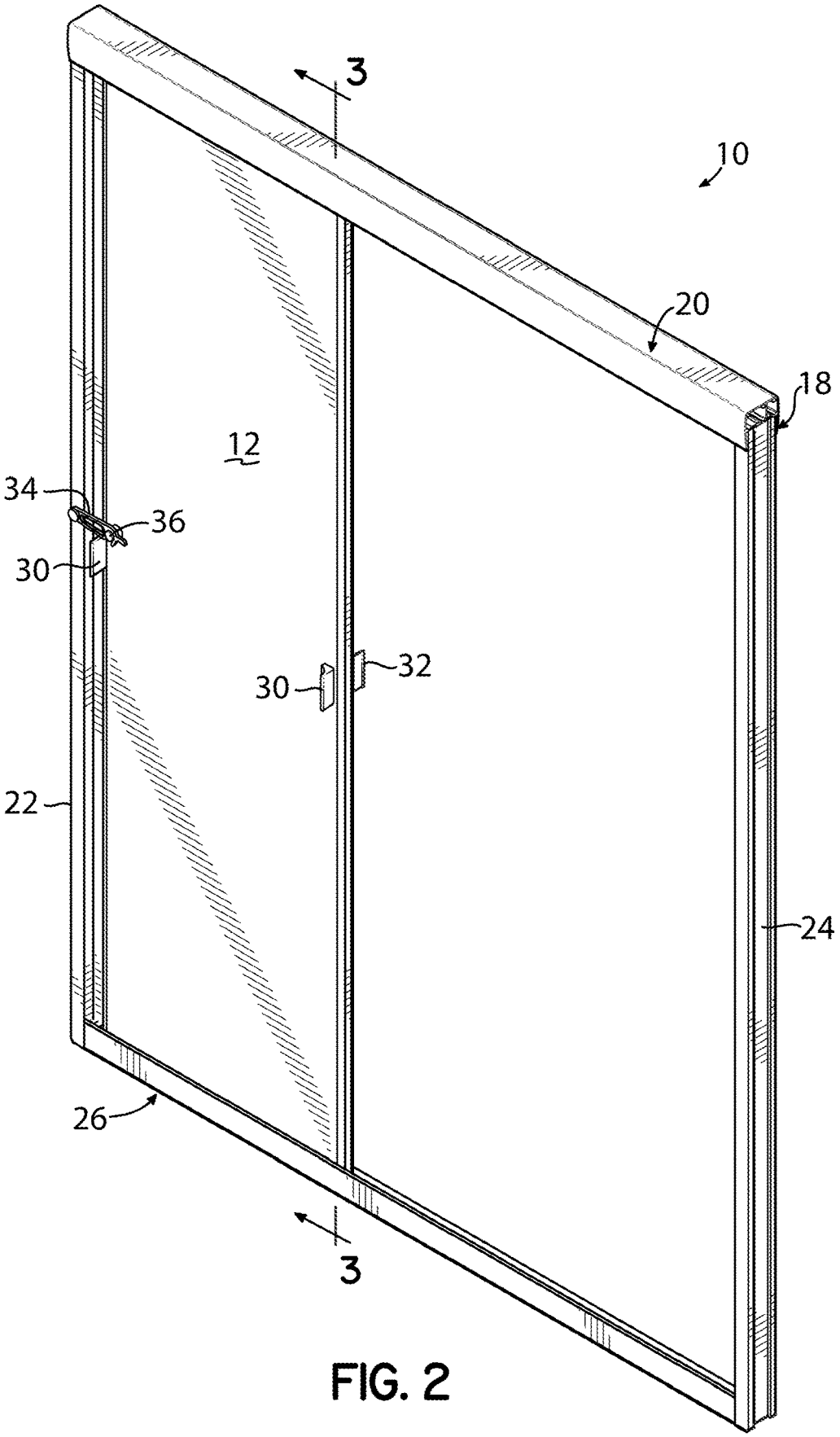
FIG. 2 is a perspective view of the shower door assembly of FIG. 1, with door panels in an open condition.
Figure 6:
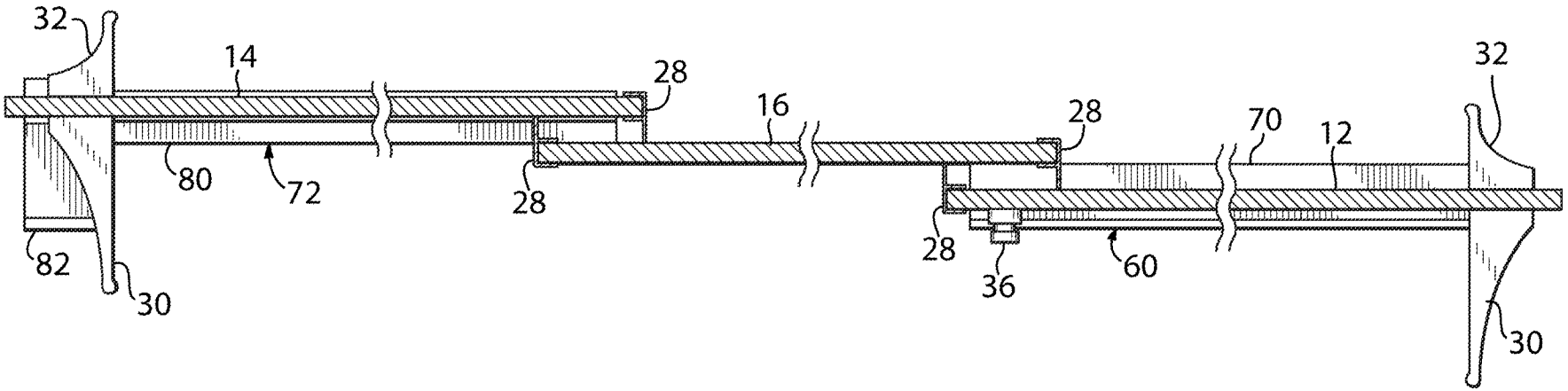
FIG. 6 is a partial cross-sectional view of the shower door assembly of FIG. 1, taken along line 6-6.

FIG. 1 depicts an exemplary multi-panel shower door assembly 10 in accordance with the principals of the present disclosure. In the embodiment shown, the shower door assembly 10 includes first, second, and third door panels 12, 14, 16 slidably moveable with respect to each other within a door frame 18 that defines an entry opening into a shower or tub enclosure. The first door panel 12 is positioned within the door frame 18 along an edge intended to face outwardly from the shower enclosure, and the second door panel 14 is positioned within the door frame 18 along an edge intended to face into the shower enclosure, with the third door panel 16 disposed therebetween, as depicted in FIG. 6. FIG. 2 depicts the exemplary shower door assembly 10 of FIG. 1 with the door panels 12, 14, 16 in an open condition achieved by sliding the first and third door panels 12, 16 into overlapping alignment with the second door panel 14. While the exemplary shower door assembly 10 has been shown and described herein as comprising three door panels 12, 14, 16, it will be appreciated that a shower door assembly in accordance with the principals of the present disclosure may alternatively include only two slidable door panels, or may have more than three door panels, as may be desired.

The door frame 18 of the exemplary shower door assembly 10 includes a header assembly 20, first and second side frame members 22, 24, and a sill member 26 at the bottom of the door frame 18, opposite the header assembly 20. Edge trim members 28 may be provided along selected edge portions of the door panels 12, 14, 16 as depicted in FIG. 6 for example, as may be desired for aesthetic and functional purposes. The shower door assembly 10 may further include one or more handles 30, 32 provided on one or more of the door panels 12, 14, 16 to facilitate moving the door panels 12, 14, 16 between a closed configuration as depicted in FIG. 1, and an open configuration as depicted in FIG. 2, for example. The door assembly 10 may further include features to facilitate securing one or more of the door panels 12, 14, 16 in an open position. In the embodiment shown, a latch 34 is provided on the first side frame member 22 and a knob 36 is provided on the first door panel 12. When the first door panel 12 is slidably moved to an open position as depicted in FIG. 2, the latch 34 may be pivoted to engage the knob 36 and thereby retain the first and third door panels 12, 16 in the open position.

Figure 3:
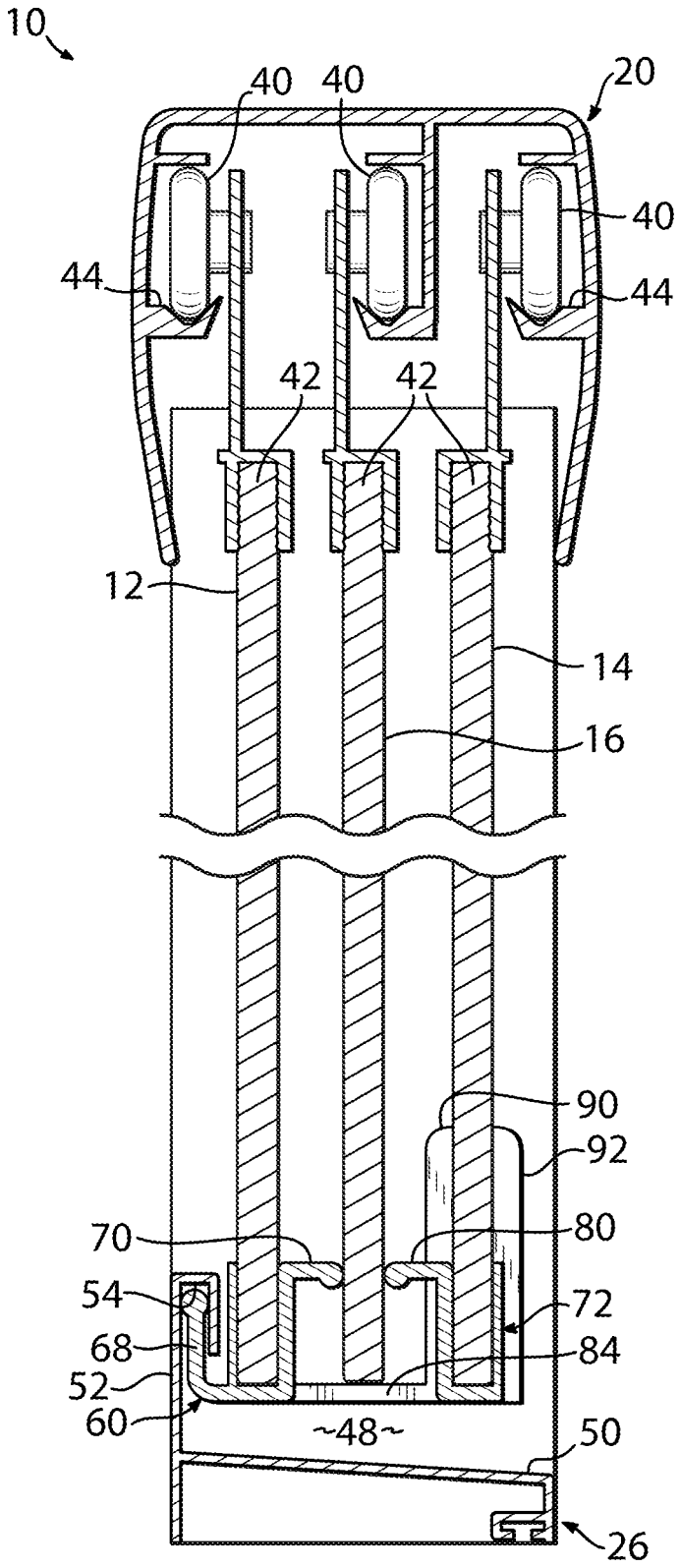
FIG. 3 is a partial cross-sectional view of the shower door assembly of FIG. 2, taken along line 3-3.
Figure 3A:
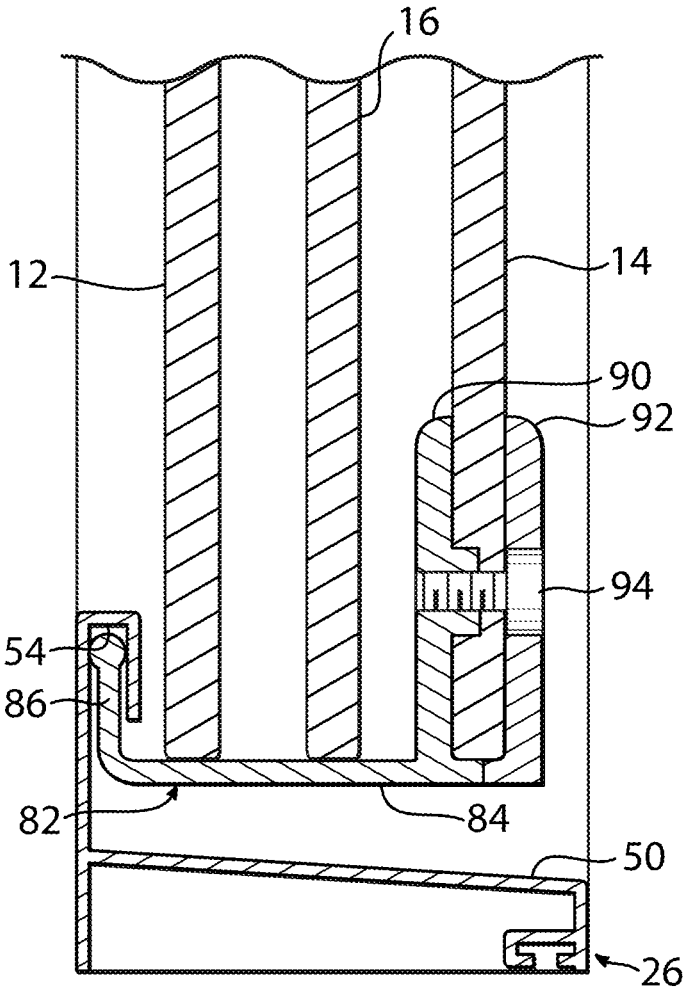
FIG. 3A is a partial cross-sectional view similar to FIG. 3, with items removed for clarity.

With continued reference to FIG. 1, and referring further to FIG. 3, the door panels 12, 14, 16 are supported proximate their upper ends for sliding movement within the header assembly 20. In the embodiment shown, each of the door panels 12, 14, 16 includes one or more roller assemblies 40 provided at the first, top ends 42 of the door panels 12, 14, 16. The roller assemblies 40 are received in respective elongate tracks 44 provided within the header assembly 20, such that the door panels 12, 14, 16 may be individually slidably moved along the length of the header assembly 20. The second, bottom ends 46 of the door panels 12, 14, 16 are unsupported and are suspended a distance above the sill member 26 to define an open, unobstructed space 48 between the second ends 46 of the door panels 12, 14, 16, as shown in FIG. 3.

With continued reference to FIG. 3, the sill member 26 includes a bottom wall 50 that generally spans a depth of the door frame 18, and a sidewall 52 that extends upwardly from the bottom wall 50 proximate an entry side of the shower enclosure. The sill member 26 further includes an elongate, downwardly opening channel 54 disposed along an upper edge of the sidewall 52. The channel 54 facilitates sliding operation of the door panels 12, 14, 16 while inhibiting lateral tilting or pivotal movement of the second ends 46 of the door panels 12, 14, 16 in a direction perpendicular to the sliding movement, as will be described more fully below. Notably, the sill member 26 does not include any tracks or guides in which water can accumulate. Instead, the bottom wall 50 of the sill member 26 has a negative gradient, sloping in a direction from the first door panel 12 toward the second door panel 14, to direct any water falling onto the sill member 26 into the interior of the shower enclosure. Because there are no tracks or other structure that can trap water, the sill member 26 may be configured to be free from drain holes or apertures which are typically found in conventional shower door assemblies.

Figure 4:
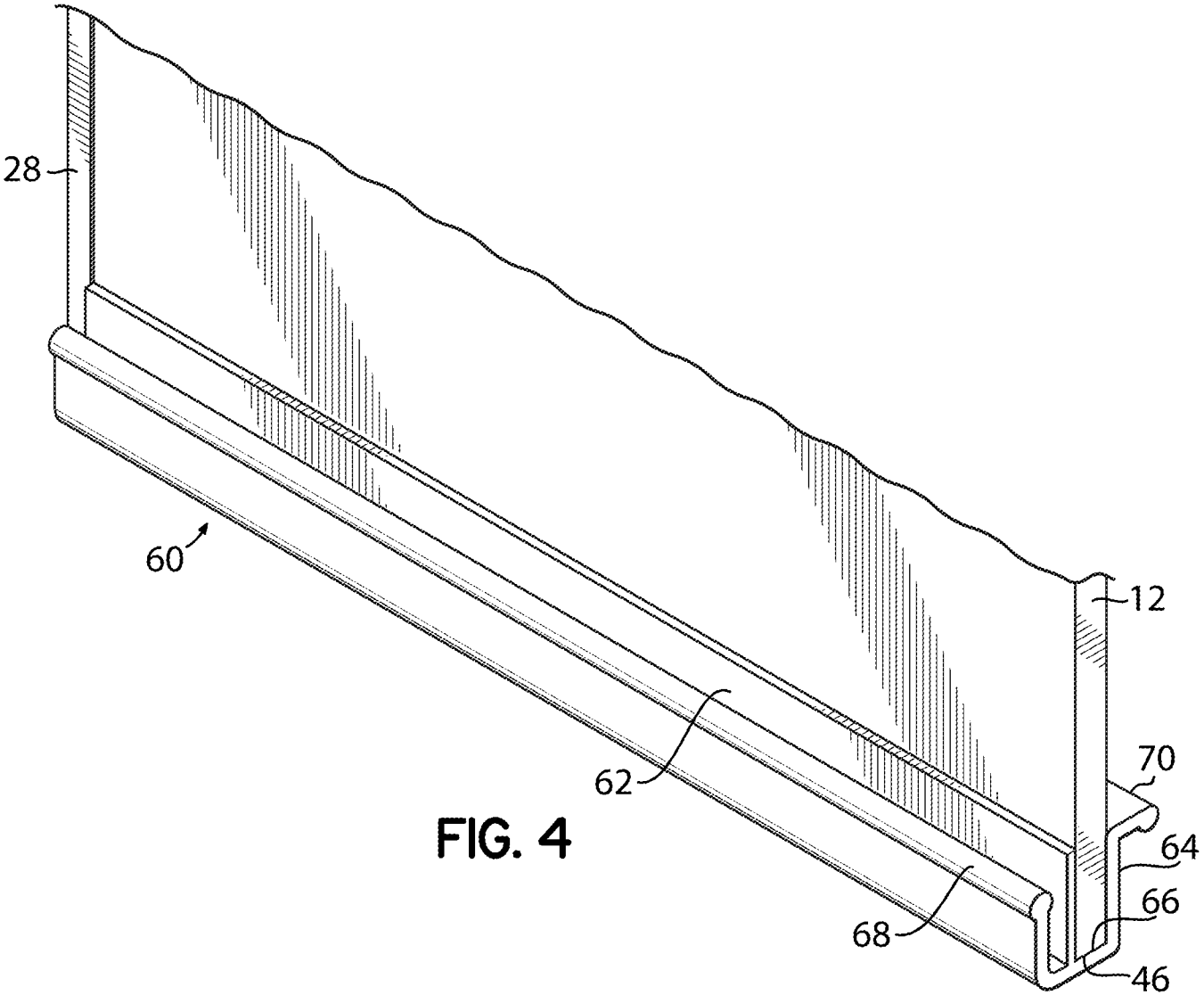
FIG. 4 is a detail view depicting a bottom portion of a first door panel of the exemplary shower door assembly of FIG. 1.

With continued reference to FIG. 3, and referring further to FIG. 4, the shower door assembly 10 further includes a first rail member 60 provided along the second, bottom end 46 of the first door panel 12. In the embodiment shown, the first rail member 60 includes a first wall 62 and a second wall 64 spaced from the first wall 62 to define a channel 66 into which the second end 46 of the first door panel 12 is received. The dimensions of the first and second walls 62, 64 of the first rail member 60 may be sized and configured to provide an interference fit with the second end 46 of the first door panel 12 when the second end 46 is received within the channel 66 so that the first rail member 60 is secured to the first door panel 12. It will be appreciated that various other methods for securing the first rail member 60 to the second end 46 of the first door panel 12 may alternatively or additionally be used. For example, adhesives, mechanical fasteners, or other suitable structure may be used as an alternative to the interference fit, or in addition to the interference fit, to secure the first rail member 60 to the second end 46 of the first door panel 12.

The first rail member 60 further includes a lip 68 extending upwardly from the second end 46 of the door panel 12 in a direction toward the first end 42 of the door panel 12. The lip 48 is sized and shaped to be received within the downwardly opening channel 54 on the sidewall 52 of the sill member 26, as depicted in FIG. 3. Cooperation between the lip 48 on the first rail member 60 and the channel 54 on the sill member 26 permits sliding movement of the first door panel 12 while inhibiting pivotal or tilting movement of the second end 46 of the door panel 12 in a direction perpendicular to the direction of sliding movement.

In the embodiment shown, the first rail member 60 extends substantially along the entire length of the first door panel 12. However, the first rail member 60 may alternatively extend along only a portion of the length of the first door panel 12, or the first rail member 60 may comprise several individual sections disposed along the length of the first door panel 12 sufficient to engage the channel 54 on the sill member 26 and inhibit pivotal or tilting movement of the door panel 12.

With continued reference to FIGS. 3 and 4, the first rail member 60 may further include a first spacer leg 70 extending laterally from the plane of the first door panel 12 in a direction toward the second and third door panels 14, 16. In the embodiment shown, the first spacer leg 70 is disposed along a top edge of the second wall 64. The first spacer leg 70 is sized and configured to engage the third door panel 16 and thereby maintain a spacing between the first door panel 12 and the third door panel 16 as depicted in FIG. 3. It will be appreciated that the first spacer leg 70 may alternatively be provided on various other portions of the first rail member 60 suitable for engaging the third door panel 16 and maintaining a spacing between the first and third door panels 12, 16, as may be desired.

Figure 5:
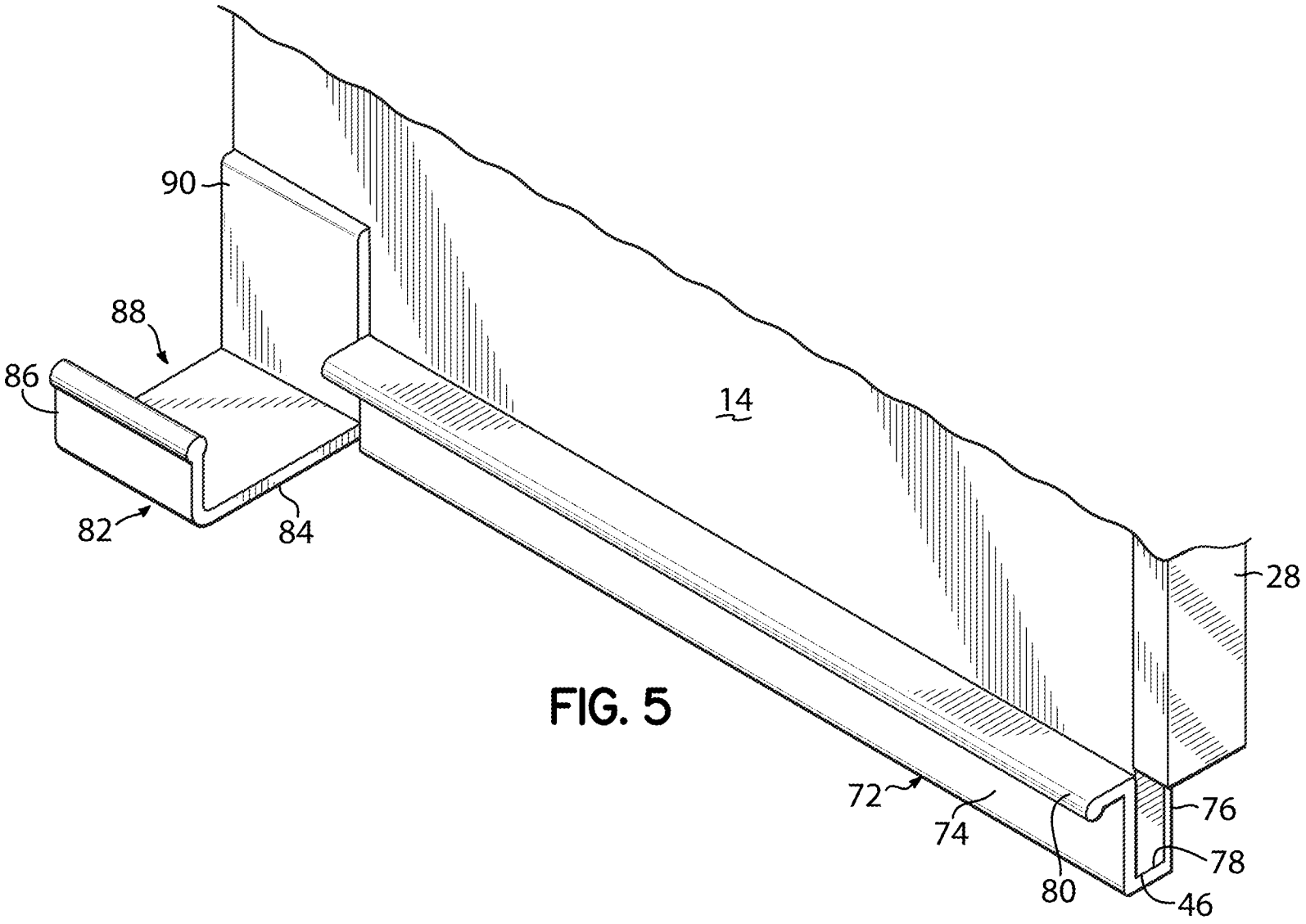
FIG. 5 is a detail view depicting a bottom portion of a second door panel of the exemplary shower door assembly of FIG. 1.

With continued reference to FIG. 3, and referring further to FIG. 5, the exemplary door assembly 10 may further include a second rail member 72 proximate the second, bottom end 46 of the second door panel 14. The second rail member 72 is similar to the first rail member 60, and includes first and second spaced apart walls 74, 76 defining a channel 78 configured to receive the second end 46 of the second door panel 14. The second rail member 72 further includes a second spacer leg 80 extending laterally from the plane of the second door panel 14 in a direction toward the third door panel 16. The second spacer leg 80 is sized and configured to engage the third door panel 16 and to maintain a spacing between the second door 14 panel and the third door panel 16 as depicted in FIG. 3.

In the embodiment shown, the second rail member 72 extends along a majority of the length of the second door panel 14. However, it will be appreciated that the second rail member 72 may alternatively extend along only a portion of the length of the second door panel 14, or that the second rail member 72 may comprise several individual sections disposed along a length of the second door panel 14 sufficient to facilitate engagement of the second spacer leg 80 with the third door panel 16 and to maintain a spacing between the second door panel 14 and the third door panel 16. Moreover, while the second spacer leg 80 is shown disposed along a top edge of the second wall 76, it will be appreciated that the second spacer leg 80 may alternatively be provided on various other portions of the second rail member 72 suitable for engaging the third door panel 16 and maintaining a spacing between the second and third door panels 14, 16, as may be desired.

The rail members 60, 72 have been shown and described herein with respect to the exemplary door assembly 10 comprising three door panels 12, 14, 16. It will be appreciated that other embodiments where a door assembly comprises two door panels, only a single rail member or spacer leg may be needed to maintain a lateral spacing between the door panels. In other embodiments comprising more than three door panels, additional rail members may be provided, and may include additional spacer legs to maintain spacing between adjacent door panels in a manner similar to that described above with respect to the first and second spacer legs 70, 80.

With continued reference to FIG. 5, the shower door assembly 10 further includes a guide bracket 82 proximate the second, bottom end 46 of the second door panel 14. In the embodiment shown, the guide bracket 82 includes a first leg 84 extending laterally outwardly from the plane of the second door panel 14 in a direction toward the first door panel 12, and a second leg 86 at a distal end of the first leg 84 and extending substantially perpendicular from the first leg 84 in a direction toward the first end 42 of the second door panel 14. The first and second legs 84, 86 of the guide bracket 82 define a channel 88 through which the other door panels 14, 16 of the door assembly 10 are slidably received during relative movement between the second door panel 14 and the first and/or third door panels 12, 16.

The upwardly extending second leg 86 of the guide bracket 82 is sized and configured to be received within the downwardly opening channel 54 of the sill member 26, in a manner similar to the first lip 68 of the first rail member 60. Accordingly, the guide bracket 82 operatively maintains the relative positions of the second ends 46 of the door panels 12, 14, 16 during use, and also aids in inhibiting pivotal or tilting movement of the door panels 12, 14, 16. The guide bracket 82 may be secured to the second end 46 of the second door panel 14 by any suitable method. For example, the guide bracket 82 may include spaced apart sidewalls 90, 92 defining a channel that facilitates securing the guide bracket 82 to the second door panel 14. For example, the guide bracket 82 may be secured to the second door panel 14 with an interference fit in a manner similar to the first and second rail members 60, 72. Alternatively, or in addition to an interference fit, the guide bracket 82 may be secured to the second door panel 14 using adhesives, mechanical fasteners 94, or any other suitable structure.

The various components of the multi-panel door assembly 10 shown and described herein may be formed from any suitable material. As non-limiting examples, the first and second rail members 60, 72 and the guide bracket 82 may be formed from extruded aluminum. In other embodiments the rail members 60, 72 and/or the guide bracket 82 may be formed from suitable plastic material, such as acrylonitrile butadiene styrene (ABS), for example. Alternatively, the rail members 60, 72 and/or guide bracket 82 may be formed as composite structures using a combination of materials suitable to provide a door assembly 10 as shown and described herein.

The exemplary door assembly 10 shown and described herein results in an unobstructed free space 48 between the bottom wall 50 of the sill member 26 and the second ends 46 of the door panels 12, 14, 16, providing a clean, aesthetically pleasing appearance and facilitating the removal of water falling on the sill member 28 by the negative gradient of the bottom wall 50, so that any water falling on the sill member 28 is directed toward the interior of the shower enclosure.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

What is claimed is:

1. A multi-panel shower door assembly for a shower enclosure, the door assembly comprising:

a sill member having a bottom wall and a side wall extending upwardly from the bottom wall, the side wall including an elongate, downwardly opening channel extending along an upper edge thereof;

a first door panel;

at least a second door panel;

the first and second door panels supported proximate respective first, top ends thereof for sliding movement relative to one another and such that second, bottom ends of the first and second door panels are spaced above the bottom wall of the sill member thereby defining an unobstructed free space between the bottom wall and the second ends of the first and second door panels, and such that the first door panel is positioned proximate an edge of the sill member configured to face outwardly from the shower enclosure, and the second door panel is positioned proximate an edge of the sill member configured to face into the shower enclosure;

a first rail member proximate the second end of the first door panel, the first rail member including a lip extending in a direction from the second end of the first door panel toward the first end of the first door panel and received in the channel;

whereby cooperation between the lip and the channel facilitates the sliding movement while inhibiting movement of the first door panel in a direction perpendicular to the sliding movement; and a guide bracket proximate the second end of the second door panel;

the guide bracket comprising:

a first leg extending laterally outwardly from the plane of the second door panel in a direction toward the first door panel, and a second leg at a distal end of the first leg and extending substantially perpendicular from the first leg in a direction toward the first end of the second door panel, the second leg received in the downwardly opening channel.

2. The shower door assembly of claim 1, further comprising a third door panel disposed between the first and second door panels.

3. The shower door assembly of claim 2, wherein the third door panel is supported proximate a first, top end thereof for sliding movement relative to at least one of the first door panel or the second door panel, and such that a second, bottom end of the third door panel is spaced above the bottom wall of the sill member.

4. The shower door assembly of claim 2, wherein the first rail member further comprises:

a spacer leg extending laterally from the plane of the first door panel in a direction toward the third door panel, the spacer leg engaging the third door panel and maintaining a spacing between the first door panel and the third door panel.

5. The shower door assembly of claim 1, wherein the bottom wall of the sill member has a negative gradient relative to horizontal, in a direction from the first door panel toward the second door panel.

6. The shower door assembly of claim 1, wherein the bottom wall of the sill member is free of apertures configured to drain liquid from the sill member.

7. A multi-panel shower door assembly, comprising:

a sill member having a bottom wall and a side wall extending upwardly from the bottom wall, the side wall including an elongate, downwardly opening channel extending along an upper edge thereof;

a first door panel;

at least a second door panel;

the first and second door panels supported proximate respective first, top ends thereof for sliding movement relative to one another and such that second, bottom ends of the first and second door panels are spaced above the bottom wall of the sill member thereby defining an unobstructed free space between the bottom wall and the second ends of the first and second door panels;

a first rail member proximate the second end of the first door panel, the first rail member including a lip extending in a direction from the second end of the first door panel toward the first end of the first door panel and received in the channel;

whereby cooperation between the lip and the channel facilitates the sliding movement while inhibiting movement of the first door panel in a direction perpendicular to the sliding movement;

a third door panel disposed between the first and second door panels; and a second rail member proximate the second end of the second door panel, the second rail member including a spacer leg extending laterally from the plane of the second door panel in a direction toward the third door panel, the spacer leg engaging the third door panel and maintaining a spacing between the second door panel and the third door panel.

8. A multi-panel shower door assembly, comprising:

a sill member having a bottom wall and a side wall extending upwardly from the bottom wall, the side wall including an elongate, downwardly opening channel extending along an upper edge thereof;

a first door panel;

at least a second door panel;

the first and second door panels supported proximate respective first, top ends thereof for sliding movement relative to one another and such that second, bottom ends of the first and second door panels are spaced above the bottom wall of the sill member thereby defining an unobstructed free space between the bottom wall and the second ends of the first and second door panels;

a first rail member proximate the second end of the first door panel, the first rail member including a lip extending in a direction from the second end of the first door panel toward the first end of the first door panel and received in the channel;

whereby cooperation between the lip and the channel facilitates the sliding movement while inhibiting movement of the first door panel in a direction perpendicular to the sliding movement; and a guide bracket proximate the second end of the second door panel;

the guide bracket comprising:

a first leg extending laterally outwardly from the plane of the second door panel in a direction toward the first door panel, and a second leg at a distal end of the first leg and extending substantially perpendicular from the first leg in a direction toward the first end of the second door panel, the first and second legs defining a channel through which the first door panel is slidably received during relative movement between the first and second door panels.

9. The shower door assembly of claim 8, further comprising:

a third door panel disposed between the first and second door panels;

the third door panel supported proximate a first, top end thereof for sliding movement relative to at least one of the first or second door panels.

10. The shower door assembly of claim 9, wherein the third door panel is slidably received in the channel defined by the first and second legs of the guide bracket during relative movement between the third door panel and the second door panel.

* * * * *